United States Patent [19]

Seiter et al.

[11] 4,427,148

[45] Jan. 24, 1984

[54] HERMETICALLY SEALED TRAY

[75] Inventors: George M. Seiter, Minneapolis; Richard Gould, St. Paul, both of Minn.

[73] Assignee: Champion International Corporation, Stamford, Conn.

[21] Appl. No.: 359,563

[22] Filed: Mar. 18, 1982

[51] Int. Cl.[3] ..... B65D 5/64

[52] U.S. Cl. ..... 229/43; 220/309

[58] Field of Search ..... 229/43; 220/229, 352, 220/309

[56] References Cited

U.S. PATENT DOCUMENTS

| | | | |
|---|---|---|---|
| 3,464,832 | 9/1969 | Mullinix | 229/43 |
| 3,488,201 | 1/1970 | Rizano | 229/43 |
| 3,580,478 | 5/1971 | Berniss | 229/43 |
| 3,767,108 | 10/1973 | Arneson | 229/2.5 |
| 4,019,675 | 4/1977 | Andersson | 229/43 |
| 4,215,797 | 8/1980 | Chen | 229/43 |
| 4,257,530 | 3/1981 | Fuller | 229/43 |
| 4,351,473 | 9/1982 | Manizya | 229/43 |
| 4,355,755 | 10/1982 | Fuller | 229/43 |

*Primary Examiner*—Herbert F. Ross

*Attorney, Agent, or Firm*—Evelyn M. Sommer

[57] ABSTRACT

A press-formed plastic coated paperboard tray is hermetically sealed by applying a hot melt or wax to indentations (e.g. relief depressions or wrinkles) formed in a flange of the tray at the corners of the tray. A film cover is then adhered to the tray over the flange and the hot melt or wax filling the indentations in the corner of the flange of the tray provides a hermetic seal for the interior of the tray and its contents, such as sterilized medical instruments, and precludes leakage of liquids housed within the tray.

6 Claims, 10 Drawing Figures

HERMETICALLY SEALED TRAY

BACKGROUND AND SUMMARY OF THE INVENTION

This invention relates to the packaging art, and more particularly, to an improved hermetically sealed press-formed paperboard tray.

Numerous types of trays made from plastic coated paperboard have been employed in the past for a variety of purposes, including the housing of moist products, sterilized materials, and food products. Such trays have been formed from unitary, plastic coated paperboard blanks using a either a drawing process or a process wherein the tray is formed by folding side and end walls of the blank along score lines and adhesively securing flap portions in the corners of the tray. The tray includes an outwardly extending flange around the entire upper edge which provides the dual function of rigidifying the tray and providing a flat surface to which a plastic cover sheet or film may be bonded in order to enclose the top of the tray after the tray has been filled.

In the case of trays formed by a drawing process, where a single sheet of paperboard is used, it is often necessary to prescore the blank of paperboard stock from which the trays are drawn at the corners thereof in order to produce evenly distributed folds in the paperboard at the corners during the drawing process. These folds or creases reduce stress concentrations in the corners while the paperboard is being formed during the drawing process and thereby eliminates potential tearing of the paperboard stock during the drawing process. The folds in the paperboard created by the prescoring thereof are present in the sidewalls of the tray and extend into the flange. The folds created in the flange result in alternating ridges and depressions forming a ribbed effect in the flange at the corners of the tray. The ribbed surface of the flange at the corners of the tray creates difficulty in bonding and complete sealing of the cover film around the entire periphery of the flange. Incomplete sealing of the cover sheet to the flange may result in some loss of a liquid product from the tray during shipping and handling and may cause degradation of a sterilized product due to exposure thereof to the surrounding environment.

Similarly, trays formed by folding a blank and adhesively securing flap portions at the corners of the tray exhibit indentations or wrinkles on the surface of the flange at the corners of the tray. Such indentations or wrinkles result when the flap portions forming the tray and/or flange corners do not conform exactly to the score lines provided in the blank. A surface indentation on the flange will also occur whenever adjacent corner flaps forming the flange are adhesively joined in overlapping relation.

Accordingly, the folded or deep drawn tray of the present invention is coated with a hot melt or wax on the edges thereof or along the depressions, indentations and/or wrinkles formed in the flange to seal the depressions, indentations and/or wrinkles to provide a leakproof container. The hot melt or wax coating is applied to the tray flanges by a roller coater or patterned to the cover film shortly before sealing. When the film cover is applied to the flange of the tray, the tray will be hermetically sealed at the corners. A suitable release agent can also be precoated on the flange portions in the corner of the tray so that upon peeling of the cover film from the tray flange, the hot melt or wax will peel off the tray with the cover precluding possible contamination of the material housed within the tray.

BRIEF DESCRIPTION OF THE DRAWINGS

Further objects and advantages of the present invention will become apparent from the following description and claims, and from the accompanying drawings, wherein:

DETAILED DESCRIPTION OF THE PREFERRED EMBODIMENT

Figure 1:
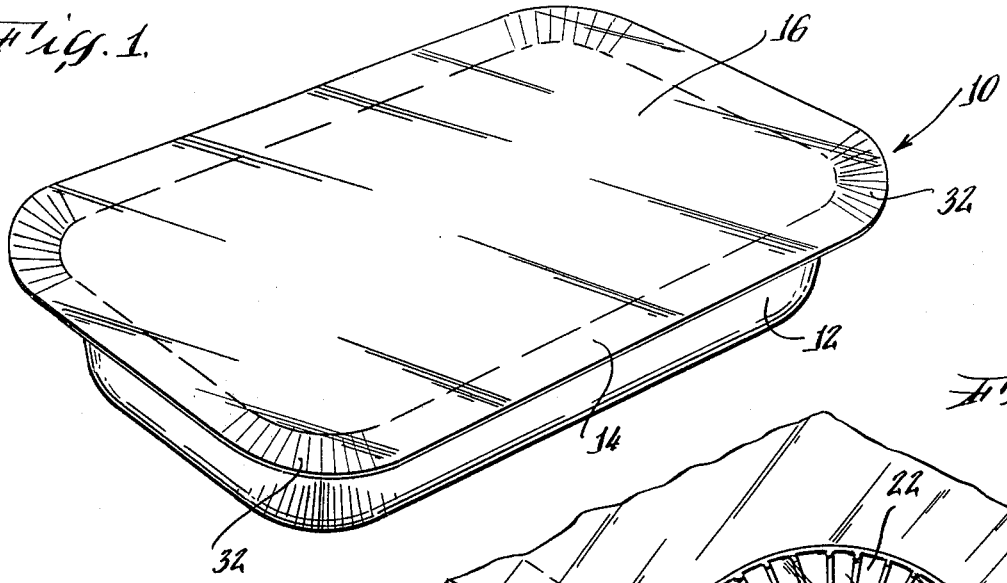
FIG. 1 is a perspective view of the improved, hermetically sealed press-formed tray of the present invention.

Referring now to the drawings in detail, wherein like numerals indicate like elements throughout the several views, the improved hermetically sealed tray of the present invention is illustrated in two embodiments in FIGS. 1 to 5 and is generally designated by the numeral 10. In each embodiment, the tray 10 comprises a lower tray portion 12 having a flange 14 sealed to a plastic film cover 16.

The tray portion 12 is formed from a unitary, one-piece paperboard blank (not shown) into a generally rectangular configuration by drawing or pressing the blank between a male and female die, which are respectively configured to conform to the interior and exterior shape of the tray 12. The blank from which the tray 10 is formed includes a plurality of stress relief, radially disposed score lines therein which produce radially extending, regularly spaced folds 32 in the flange 14 at the corners of the tray 10. Folds 32 are defined by upstanding ridges 34 and alternating depressions 36 which provide an uneven, ribbed effect in the flange 14 at the tray corners.

The side wall 20 of the tray portion 12 is merged into the essentially horizontal flange 14 integral with the upper edges of the side wall 20 and extends completely around the perimeter of the tray 10. During the press-forming of the tray portion 12, folds 32 which create the ridges and depressions 34 and 36, respectively, are produced in the flange 14. The ridges 34 are substantially compressed during manufacture of the tray 10 such that the surface of ridge 34 is essentially co-planar with the upper face of the flange 14 between the corners of the tray 10.

The interior of the tray 10 and upper surfaces of flange 14 are provided with a plastic layer (not shown) bonded thereto. The plastic layer may comprise any film-forming polymeric material such as polyamide, polyethylene, but the preferred form consists of a polyester such as polyethylene terphthalate (PTC) applied to the surface of the paperboard substrate. The plastic layer is applied to the paperboard substrate by extrusion or lamination prior to forming the blank into the tray 10. The cover sheet 16 adapted to be bonded to the upper face of flange 14 may be of a compatible plastic material so as to be able to effect a bond with the polyester on the flange, and preferably comprises polyethylene terphthalate.

Figure 2:
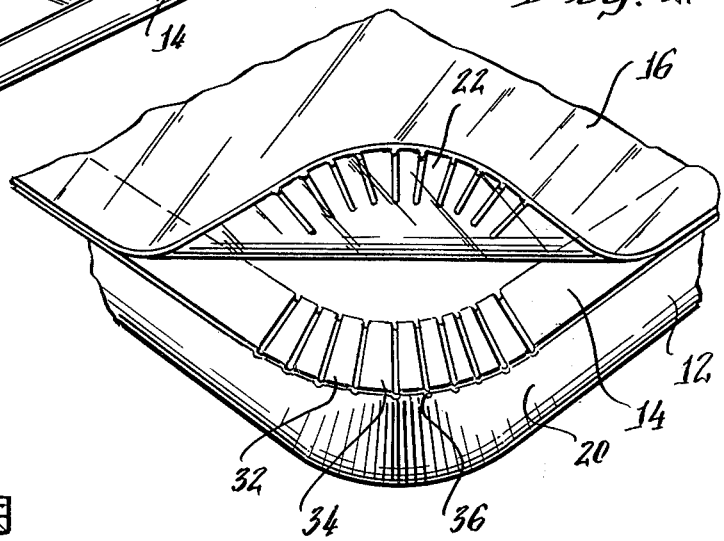
FIG. 2 is an enlarged, fragmentary perspective view of one corner of the tray of FIG. 1, with the cover sheet partially removed.

In order to assure that the tray 10 is hermetically sealed upon application of cover sheet 16 to flange 14, that is, that no air enters the interior of the tray through the depression 36 at the corner of the tray, the tray flange may be coated with a hot melt or wax material 22 to seal the grooves or depressions 36 at the corners of the tray flange to provide a leak-proof container once the film 16 is adhered to the flange. The hot melt or wax coating could be applied to the tray flange by a roller coater and the hot melt or wax should be compatible so as to adhere to the cover film 16. Prior to applying the hot melt or wax to the corners of the flange, a suitable release agent could be applied to the flange so that upon removing of the film cover 16 as illustrated in FIG. 2, the hot melt or wax coating 22 will peel from the flange with the cover film 16 to preclude possible contamination of the contents of the tray 10. Sealing of the cover film 16 to the flange 14 can also be effected utilizing a hot roller or platen.

Figure 3:
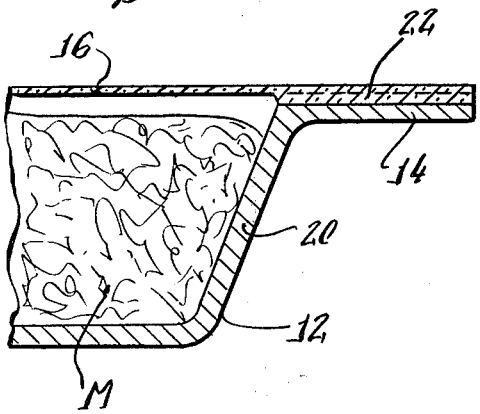
FIG. 3 is a cross-sectional view of the tray corner illustrated in FIG. 2.
Figure 4:
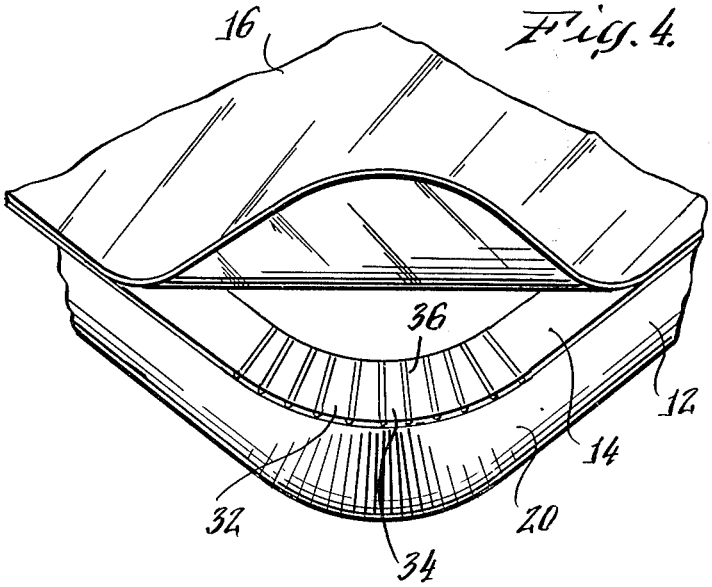
FIG. 4 is an enlarged, fragmentary perspective view of a corner of an alternate form of the press-formed tray of the present invention.
Figure 5:
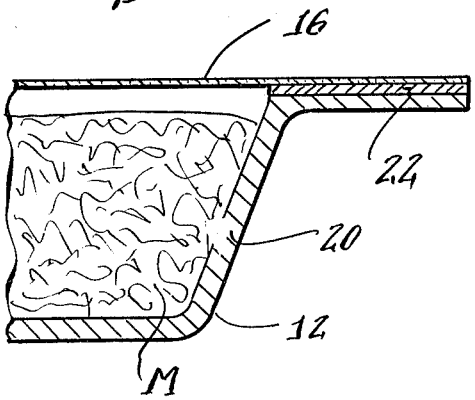
FIG. 5 is a cross-sectional view of the corner of the tray illustrated in FIG. 4.
Figure 6:
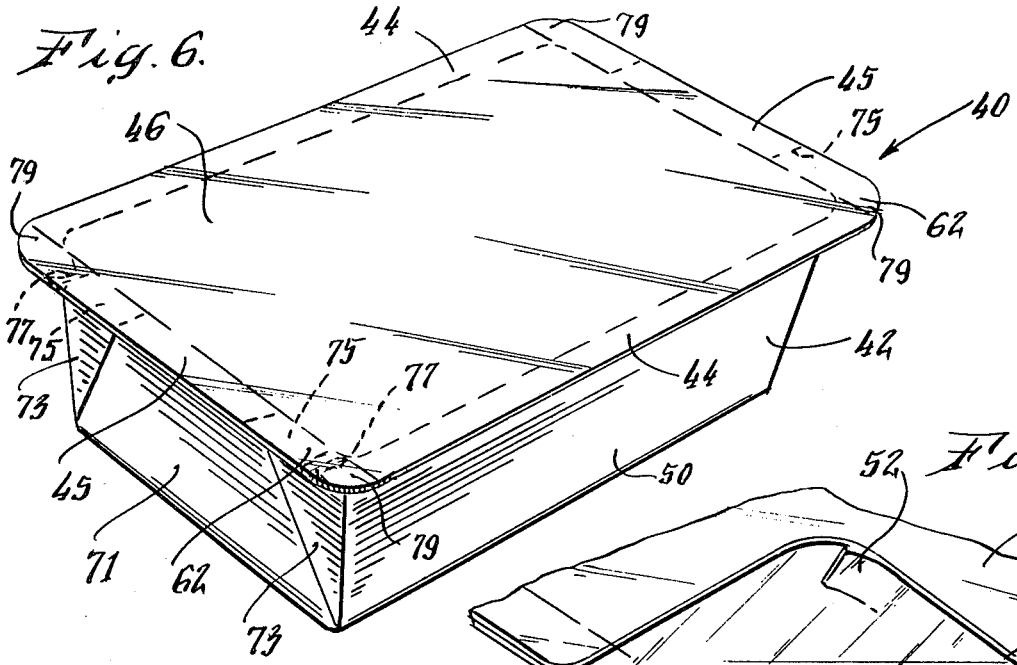
FIG. 6 is a perspective view of the improved, hermetically sealed tray of the present invention formed from a folded unitary blank.

As shown in FIGS. 2 and 3, the hot melt or wax coating could be applied as a pattern to the film cover 16, itself, before sealing or can be applied directly to the tray edges by a roller coater as illustrated in FIGS. 4 and 5.

The use of the hot melt or wax assures that the contents or material M within the tray is hermetically sealed to the atmosphere when the cover film 16 is applied to the flange 14 of the tray 10.

FIGS. 6 to 10 show two other embodiments of the present invention, wherein a tray formed from a folded unitary blank is generally designated by the numeral 40. In each of these embodiments, the tray 40 comprises a lower tray portion 42 having a flange 44, 45 sealed to a plastic film cover 46.

The tray portion 42 is formed from a unitary, one-piece paperboard blank (not shown) into a generally rectangular configuration by folding the blank along score lines thereon. The blank from which the tray 40 is formed includes corner flaps 73 which are folded over end wall 71 to form the corners of tray 40. Corner flaps 73 have tabs 75 hingedly connected thereto, which tabs are adhesively secured to the bottom surface of flange 45 to maintain corner flaps 73 in their proper position, overlying end wall 71. Flange 44 includes tabs 77 which are in overlapping relationship with and adhesively secured to corresponding tabs 79 of flange 45. Overlapping tabs 77 and 79 create an indentation or stepped-edge 62 in the corners of tray 40.

The interior of the tray 40 and upper surfaces of flanges 44 and 45 are provided with a plastic layer (not shown) bonded thereto. The plastic layer may comprise any film-forming polymeric material such as polyamide, polyethylene, but the preferred form consists of a polyester such as polyethylene terphthalate (PTC) applied to the surface of the paperboard substrate. The plastic layer is applied to the paperboard substrate by extrusion or lamination prior to forming the blank into the tray 40. The cover sheet 46, adapted to be bonded to the upper face of the flanges 44 and 45, may be of a compatible plastic material so as to be able to effect a bond with the polyester on the flanges, and preferably comprises polyethylene terphthalate.

Figure 7:
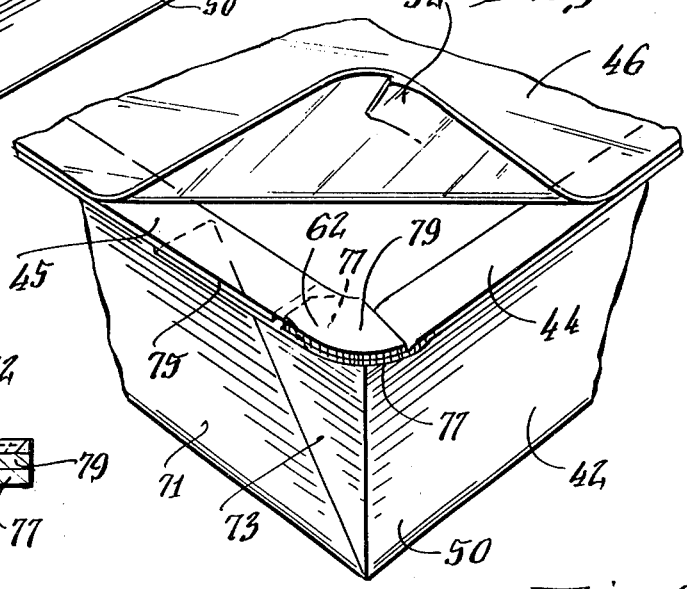
FIG. 7 is an enlarged, fragmentary perspective view of one corner of the tray of FIG. 6, with the cover sheet partially removed.

In order to assure that the tray 40 is hermetically sealed upon application of cover sheet 46 to flanges 44 and 45, that is, that no air enters the interior of the tray through the stepped edge 62 at the corner of the tray, the tray flange may be coated with a hot melt or wax material 52 to seal the indentations or stepped edges 62 at the corners of the tray where flange tabs 77 and 79 overlap to provide a leak-proof container once the film 46 is adhered to the flanges. The hot melt or wax coating could be applied to the tray flanges by a roller coater and the hot melt or wax should be compatabile so as to adhere to the cover film 46. Prior to applying the hot melt or wax to the corners of the flanges, a suitable release agent could be applied to the flanges so that upon removing of the film cover 46 as illustrated in FIG. 7, the hot melt or wax coating 52 will peel from the flange with the cover film 46 to preclude possible contamination of the contents of the tray 40. Sealing of the cover film 46 to the flanges 44 and 45 can also be effected utilizing a hot roller or platen.

Figure 8:
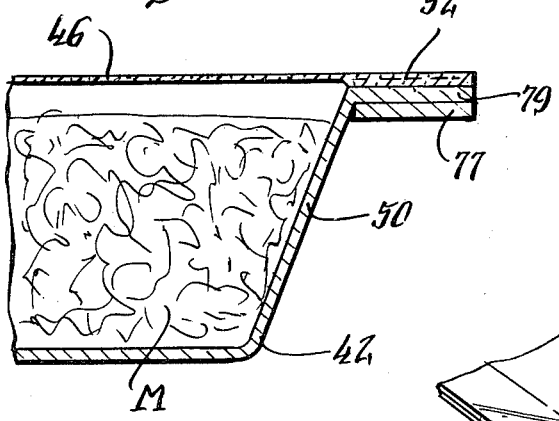
FIG. 8 is a cross-sectional view of the tray corner illustrated in FIG. 7.
Figure 9:
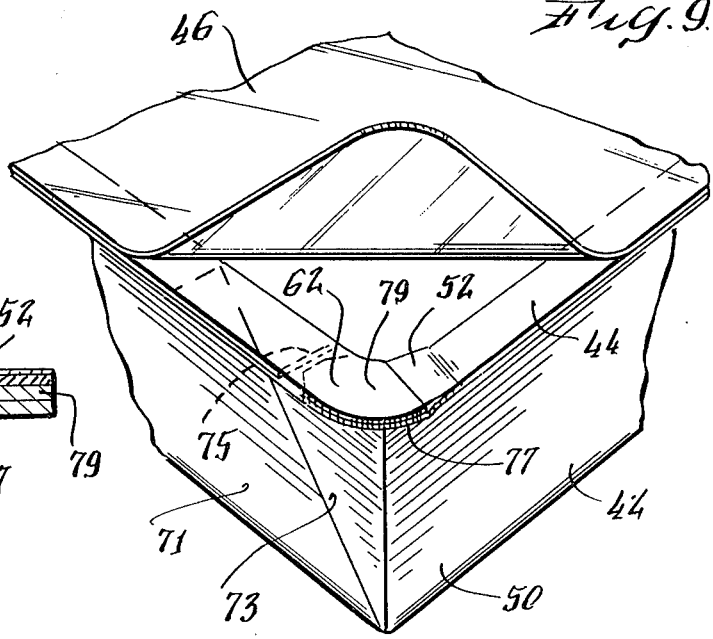
FIG. 9 is an enlarged, fragmentary perspective view of a corner of an alternate form of the folded tray of the present invention.
Figure 10:
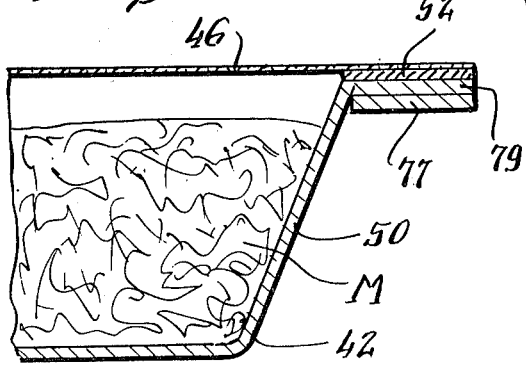
FIG. 10 is a cross-sectional view of the corner of the tray illustrated in FIG. 9.

As shown in FIGS. 7 and 8, the hot melt or wax coating could be applied to the film cover 46, itself, before sealing or can be applied directly to the tray edges by a roller coater as illustrated in FIGS. 9 and 10.

The use of the hot melt or wax assures that the contents or material M within the tray is hermetically sealed to the atmosphere when the cover film 46 is applied to the flanges 44 and 45 of the tray 40.

What is claimed as new is as follows:

1. A plastic coated paperboard tray comprising:

a bottom wall, a side wall joined with said bottom wall and extending upwardly therefrom, a flange presenting a bonding surface extending along the upper edge of said tray side wall, said flange extending outwardly away from said side wall and around the periphery of said tray, said flange including a plurality of corner portions along the periphery of said tray, said corner portions of said tray including a plurality of depressions and ridges therein extending radially outward at said corners transverse to the length of said flange, and a heat-sealable material disposed along said flange at the corners thereof filling said depressions and overlying said ridges so that it assumes the shape of said ridges and depressions, and a cover sheet for enclosing the top of said tray secured hermetically to the bonding surface of said flange and heat-sealable material, said heat-sealable material is integrally formed on said cover sheet in a complementary pattern to said depressions on said flange prior to applying said cover sheet to said tray.

2. The tray of claim 1 wherein said heat-sealable material is wax.

3. The tray of claim 1 including a release agent between said flange and heat-sealable material on said flange.

4. A plastic coated paperboard tray comprising:

a bottom wall, a pair of end walls joined with said bottom wall and extending upwardly therefrom, a pair of side walls joined with said bottom wall and extending upwardly therefrom, said side and end walls forming tray corners at their adjacent edges, a first pair of flange portions presenting a bonding surface extending along the upper edges of said tray side walls, a second pair of flange portions presenting a bonding surface extending along the upper edges of said tray end walls, the ends of each of said first pair of flange portions having tabs which are joined, by overlapping engagement, to corresponding adjacent tabs of said second pair of flange portions to form a continuous stepped flange along the periphery of said tray, a heat-sealable material disposed along said continuous flange at the corners thereof overlying said stepped flange so that it fills said stepped flange and assumes the shape of the stepped flange to provide a smooth transition across said bonding surfaces in the areas where said tabs overlap, and a cover sheet for enclosing the top of said tray secured hermetically to the bonding surfaces of said continuous flange and said heat-sealable material, said heat-sealable material is integrally formed on said cover sheet in a complimentary pattern to said overlapping engagements on said flange prior to applying said cover to said tray.

5. The tray of claim 4 wherein said heat-sealable material is wax.

6. The tray of claim 4 including a release agent between said flange and heat-sealable material on said flange.

* * * * *